US005119115A

United States Patent [19]

Buat et al.

[11] Patent Number: 5,119,115

[45] Date of Patent: Jun. 2, 1992

[54] THERMAL INK JET PRINT HEAD WITH REMOVABLE INK CARTRIDGE

[75] Inventors: Mario Buat, Carema; Renato Conta, Ivrea; Adriano Fetta, Castellamonte, all of Italy

[73] Assignee: Ing. C. Olivetti & C. S.p.A., Ivera, Italy

[21] Appl. No.: 542,908

[22] Filed: Jun. 25, 1990

[30] Foreign Application Priority Data

Jul. 13, 1989 [IT] Italy ..... 67585 A/89

[51] Int. Cl.[5] ..... B41J 2/175; B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,277,791 | 7/1981 | Rosenstock | 346/140 |
| 4,368,478 | 1/1983 | Koto | 346/140 |
| 4,419,678 | 12/1983 | Kasugayama | 346/140 |
| 4,628,334 | 12/1986 | Dagna | 346/140 |
| 4,633,274 | 12/1986 | Matsuda | 346/140 |
| 4,700,202 | 10/1987 | Kuranishi et al. . | |
| 4,760,409 | 7/1988 | Kiyohara | 346/140 |
| 4,771,295 | 9/1988 | Baker et al. | 346/1.1 |
| 4,878,069 | 10/1989 | Kiyohara | 346/140 R |

FOREIGN PATENT DOCUMENTS 90307312 4/1991 European Pat. Off. .

*Primary Examiner*—Joseph W. Hartary

*Attorney, Agent, or Firm*—Banner, Birch, McKie & Beckett

[57] ABSTRACT

In a thermal ink jet print head the ink is expelled in the form of small drops through a plurality of nozzles communicating with corresponding expulsion chambers for expulsion of the ink through the effect of rapid heating of heater elements contained in the expulsion chambers. The nozzles, the expulsion chambers, the heater elements and the associated electrical conductors are constructed in a plurality of metal layers and insulating layers supported by a silicon plate. The plate is fixed to the structure of the head and is supplied with ink contained in a movable cartridge fitted to the structure of the head. The cartridge comprises a rigid reservoir containing a sponge saturated with ink which can be hydraulically connected to the head by means of a needle-type conduit mounted on the head and which perforates a rubber membrane of the cartridge. During the periods of storage and inactivity of the head, the cartridge is removed, permitting drying of the nozzles to avoid possible nozzle blockages and corrosion of the layers of the plate by the ink.

4 Claims, 4 Drawing Sheets

THERMAL INK JET PRINT HEAD WITH REMOVABLE INK CARTRIDGE

BACKGROUND OF THE INVENTION

The present invention relates to a thermal ink jet print head.

A print head for a thermal ink jet printer is known in which a multi-layer print plate carrying the nozzles and electrical terminals for pilot control thereof is fixed to an end wall of a reservoir containing a spongy body impregnated with ink.

The nozzles are hydraulically connected to the interior of the reservoir by way of a supply conduit passing through the plate and disposed at a position corresponding to an opening in the end wall of the reservoir. The electrical terminals of the print plate are soldered or welded to corresponding conductors of a flat cable fixed to the end wall on the outside of the reservoir. The flat cable carries conductive areas or pads which can be connected under the effect of pressure to corresponding fixed terminals of the printer.

The reservoir with the plate which is fixed with respect thereto form an integrated printing and supply unit which is mounted removably on the carriage of the printer. When the ink is exhausted the integrated unit is replaced by another unit loaded with ink.

As will be apparent, the ink always fills the nozzles and always remains in contact with the internal metal layers of the plate. During long periods of storage or inactivity of the integrated head, it may be found that the arrangement suffers from blockages of nozzles by virtue of drying of the ink or corrosion phenomena in respect of internal layers of the plate, with a consequential deterioration in the quality of printing and a reduction in the level of efficiency of the head itself. In addition since the life of a print head is much longer than the period for which the ink contained in the reservoir lasts, each time that the integrated unit is replaced, it is necessary to throw away a print plate which is still effective.

An object of the present invention is that of providing a thermal ink jet print head which is free from the above-discussed disadvantages.

More particularly another object of the present invention is to make complete use of the printing plate for the whole of its period of effectiveness.

A further object of the present invention is to increase the period of effectiveness of the printing plate, keeping it free from ink during the periods of printing inactivity in order to minimise the risk of corrosion by the ink.

SUMMARY OF THE INVENTION

In a thermal ink jet print head the ink is expelled in the form of small drops through a plurality of nozzles communicating with corresponding expulsion chambers for expulsion of the ink through the effect of rapid heating of heater elements contained in the expulsion chambers. The nozzles, the expulsion chambers, the heater elements and the associated electrical conductors are constructed in a plurality of metal layers and insulating layers supported by a silicon plate. In this invention the plate is fixed to the structure of the head and is supplied with ink contained in a removable cartridge fitted to the structure of the head. The cartridge comprises a rigid reservoir containing a sponge saturated with ink and can be hydraulically connected to the head by means of a needle-type conduit mounted on the head and which perforates a rubber membrane of the cartridge. During periods of storage and inactivity of the head, the cartridge can be removed, permitting drying of the nozzles to avoid possible nozzle blockages and corrosion of the layers of the plate by the ink.

BRIEF DESCRIPTION OF THE DRAWINGS

These and other aspects of the invention will be more clearly apparent from the following description of a preferred embodiment given by way of non-limiting example with reference to the accompanying drawings, in which.

DETAILED DESCRIPTION OF THE PREFERRED EMBODIMENT

Figure 2:
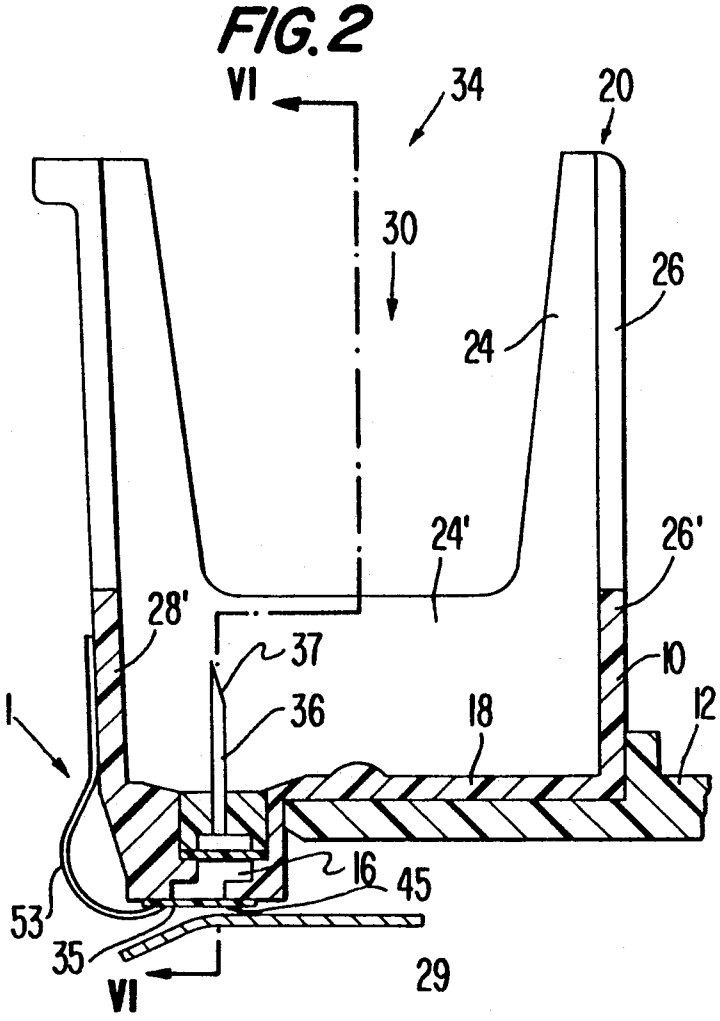
FIG. 2 is a view in section of a support structure of the head shown in FIG. 1.
Figure 1:
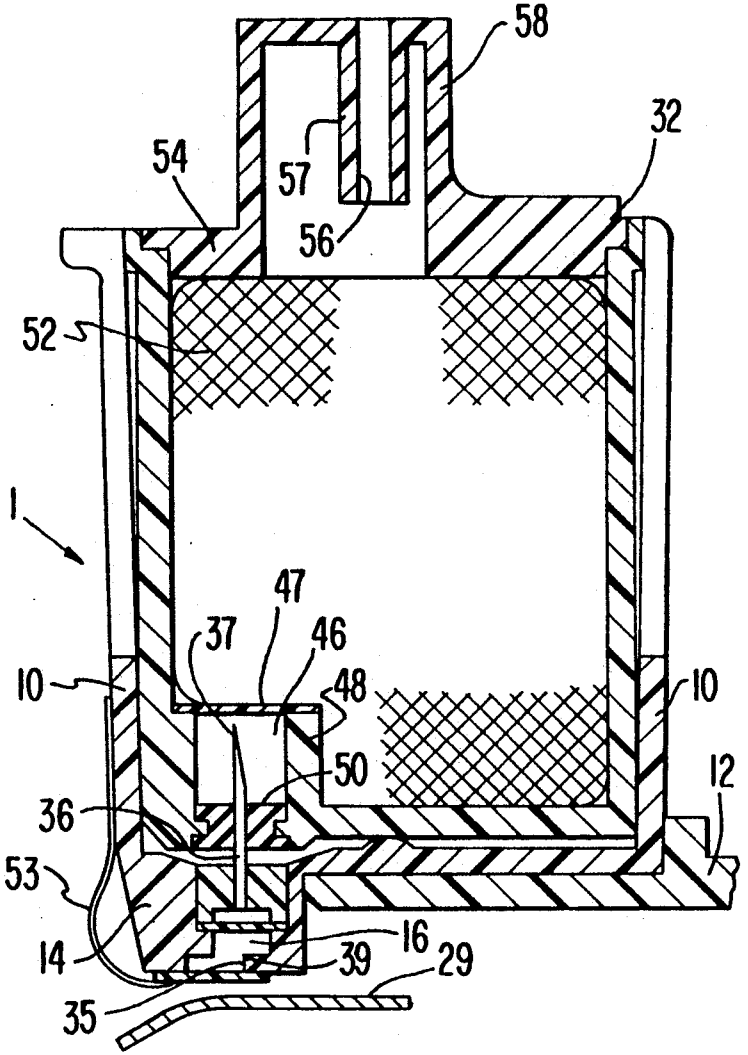
FIG. 1 is a view in section of a thermal ink jet print head according to the invention.

Referring to FIGS. 1 and 2 a print head 1 comprises a support structure 10 fixed on a movable carriage 12 of a printer (not shown in the drawings but well known to those skilled in the art).

Provided in a projection portion 14 of the structure 10 is a cavity or intermediate reservoir 16 which is open downwardly and closed upwardly by an end wall 18 of the structure 10.

The structure 10 comprises four arms 20 to 23 connected to the end wall 18 and extending substantially in a direction perpendicular thereto; the arms 20 and 23 of the four arms are visible in the drawing. Each arm, for example the arm 20 (FIG. 2). is formed by two elongate portions 24. 26 of two adjacent, mutually perpendicular side walls 24' and 26' of the structure 10. The walls 24' and 26' and two other side walls which are respectively parallel to and facing the walls 24' and 26' and of which only the wall 28' is visible define a receiving space 30 for receiving an ink cartridge 32 (FIG. 1). The cartridge 32 can therefore be introduced into and removed from the space 30 by way of an opening 34 opposite to the end wall 18.

The four arms 20–23 therefore perform the function of angular guides for the cartridge 32 during the operation of inserting it into the space 30.

A tubular element 36 is fixed to the wall 18 to communicate the intermediate reservoir 16 with the space 30. The element 36 extends within the space 30 and has a pointed end 37 which is directed towards the opening 34.

Fixed on the projection portion 14 (see FIG. 1) is a thermal ink jet print element 35 or print head of a type well-known in the art for printing dots on a printing carrier 29. The element 35 closes the intermediate reservoir 16 downwardly in FIGS. 1 and 2 and is formed by a silicon plate 36 supporting a plurality of metal layers interposed between insulating layers and layers of resin, of the type described for example in Italian patent application No. 67044-A/89 publication date Jul. 26, 1990. More particularly the ink is projected on to the carrier 29 through a plurality of nozzles 45 (see FIG. 2) communicating with corresponding expulsion chambers (not shown in the drawings) and provided in one of the insulating layers of the element 35. The expulsion chambers communicate with the intermediate reservoir 16 by way of a supply duct passing through the silicon plate 39. Disposed on the outside face of the plate 39, which is directed towards the printing carrier 29, are conductive areas or pads connected by way of one of the metal layers of the print element 35 to heater elements (not shown) contained in the expulsion chambers. Electrical conductors of a flat cable 53 which is externally fixed to the support structure 10 are welded or soldered to the areas or pads on the plate 39.

Figure 4:
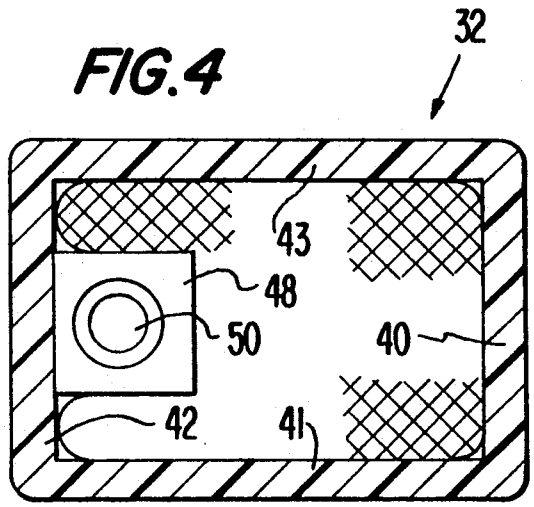
FIG. 4 is a view in horizontal section taken along the line IV—IV in FIG. 3.
Figure 3:
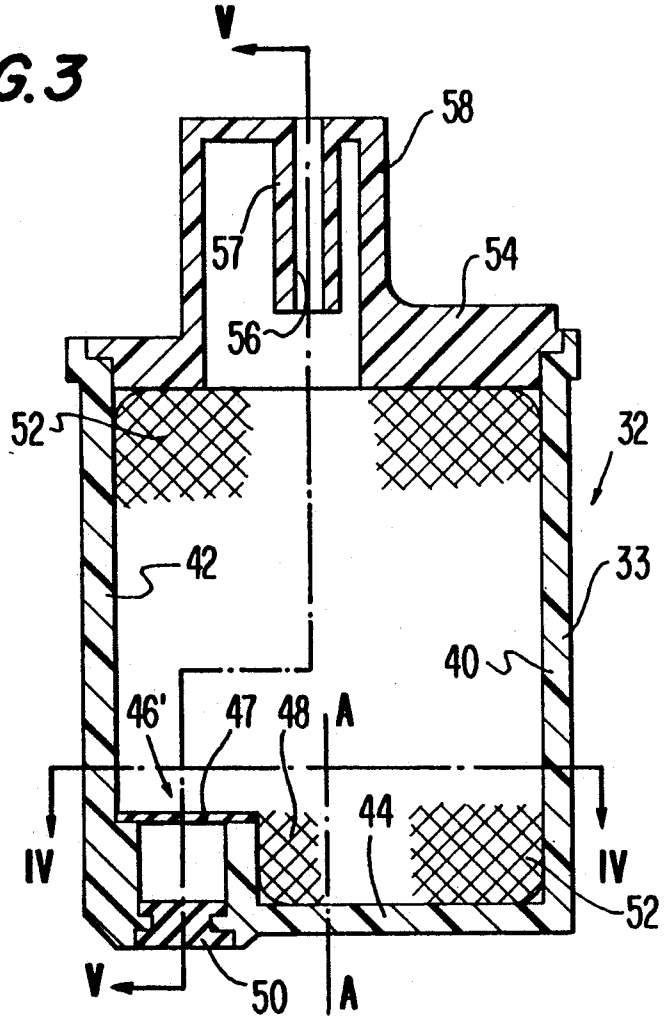
FIG. 3 is a view in section of a cartridge for the ink used with the head in FIG. 1.
Figure 6:
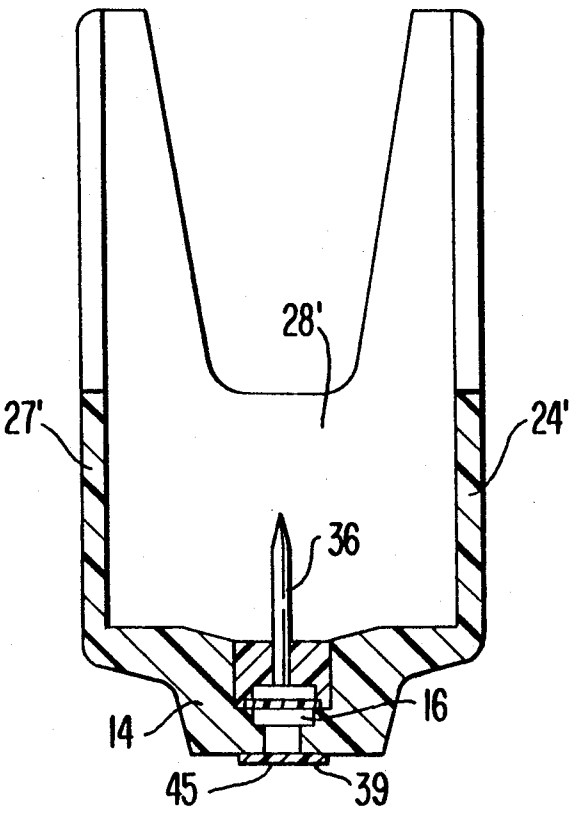
FIG. 6 is a view in section taken along line VI—VI in FIG. 2.
Figure 5:
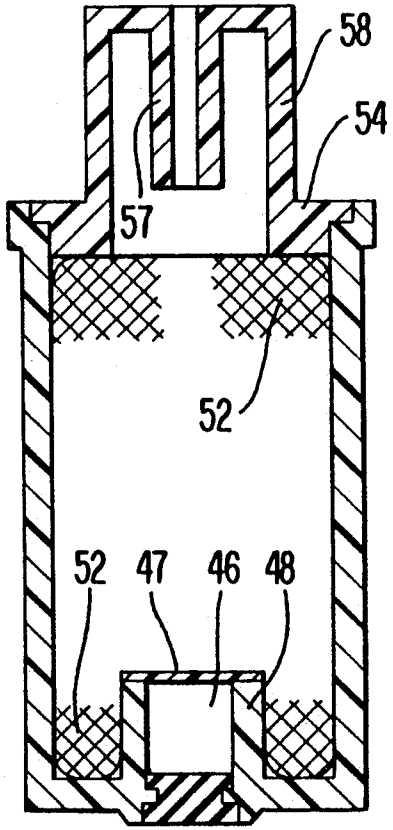
FIG. 5 is a view in section taken along line V—V in FIG. 3.

The cartridge 32 (see FIGS. 3 and 4) comprises a container 33 of substantially parallelepipedic shape and formed by four side walls 40, 41, 42, 43 which are fixed with respect to a front wall 44.

Provided in the interior of the container 33 is an auxiliary space 46 disposed in a lateral position with respect to a longitudinal axis A—A of the cartridge 32 and delimited by the front wall 44, the side wall 42 and an internal wall 48 perpendicular to the wall 44. The space 46 on one side is open towards the interior of the cartridge 32 while on the opposite side it is closed by an element 50 of resilient material, for example soft rubber. The space 46, and the closure element 50 when the cartridge 32 is fitted into the support structure 10, are disposed in a position corresponding to the tubular element 36 which therefore perforates the element 50 and with its end 37 penetrates into the space 46 of the cartridge.

The container 33 is filled with a spongy material 52 with communicating pores, the material being capable of being impregnated with ink. Disposed on the mouth opening 46' of the auxiliary space 46 is a metal grill 47 for preventing the spongy material 52 from penetrating into the space 46.

After the container 33 has been filled with the sponge 52, the container 33 is closed with a cover 54 which is sealed to the edge of the walls 40–43, which is opposite to the wall 44.

The cover 54 is provided with an opening 56 to the exterior to communicate the part of the sponge in contact with the cover 54 with external atmospheric pressure. The opening 56 comprises a conduit 57 extending towards the interior of the container 33 and disposed in a dome 58 projecting outwardly on the cover 54.

The cartridge 32 is filled with ink for example by drawing air from the conduit 56 (see FIG. 3) and introducing ink from the bottom through the closure 50 by means of a needle tube similar to the tube 36 in FIG. 2 and communicating with an ink reservoir (not shown in the drawings). The cartridge is loaded when the ink has filled the auxiliary space 46 and has completely impregnated the spongy material 52.

The ink-filled cartridges can be preserved for a long period of time and in any position without any danger of loss of ink, in that the capillary action of the spongy material 52 retains the ink within the container 33.

In order to initiate a printing operation, an ink-filled cartridge 32 is fitted into the space 30 (FIG. 2) of the support structure 10 in such a way that the end 37 of the tubular element 36 penetrates into the auxiliary space 46 (FIG. 1) after having perforated the closure element 50.

Before initiating the printing operation, the head 1 is moved to a suction station (not shown in the drawings) in which the ink contained in the cartridge 32 is sucked through the nozzles 45 (see FIG. 2). In that way the ink forms in each nozzle a meniscus whose surface tension balances a depression created in the auxiliary space 46 (FIG. 1) and in the auxiliary reservoir 16 due to the effect of the capillary action of the spongy material 52. That depression is of the order of 1–5 cm water gauge when the head 1 is not operating while it can rise to 20–30 cm water gauge during the printing operation when a certain amount of ink is sucked in again from the reservoir 16 of the printing element 35 to replace the ink expelled from the nozzles 45. The use of a cartridge 32 for the ink, which is separate from the head 1, makes it possible to maintain the reservoir 16 and the printing element 35 empty of ink during the period of storage of the printer, thus ensuring that the nozzles are effective during subsequent operation of the printer.

In addition in the event of an interruption in activity of the printer the cartridge 32 when already mounted on the head 1 may be removed and stored while the reservoir 16 and the nozzles 45 can be cleaned to remove the residual ink. That procedure avoids blockage of the nozzles by dried ink and minimises the risk of corrosion or infiltration of ink into the metal and insulating layers of the printing element 35 due to the prolonged presence of ink in contact with those layers.

Figure 7:
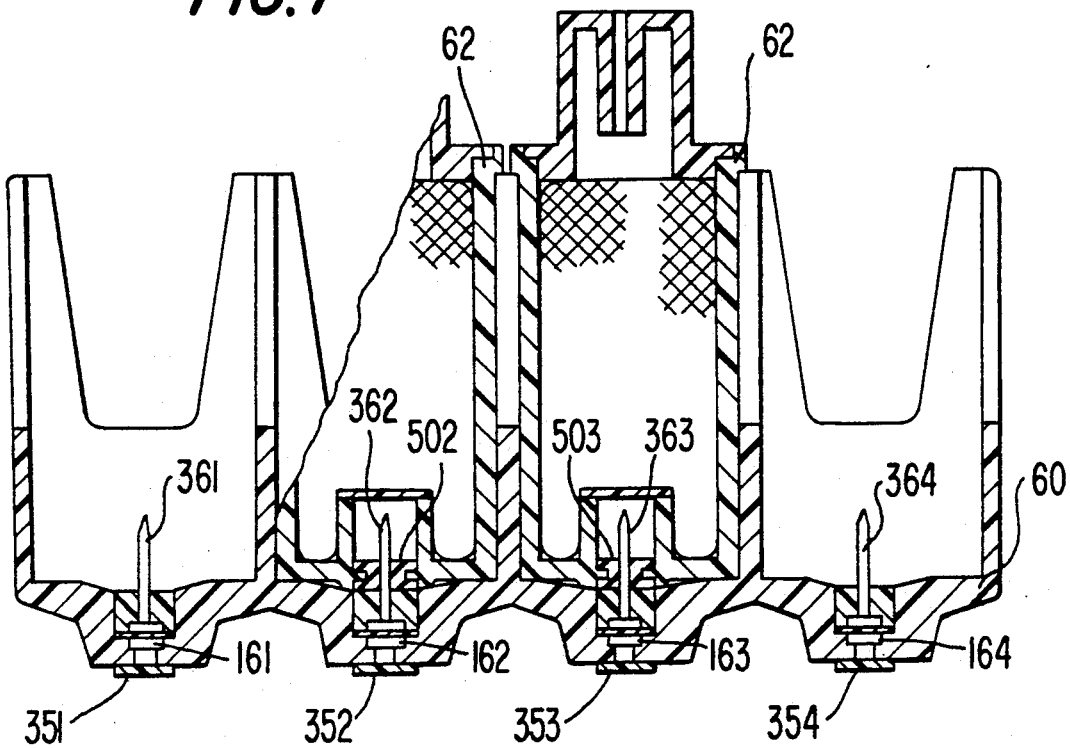
FIG. 7 is a view in longitudinal section of a multicolor head according to the invention.

The head 1 can also be used for multi-colour printing. Referring to FIG. 7, a support structure 60 may contain a plurality of cartridge 62 containing inks of different colors.

The support structure 60 is capable of carrying for example four cartridges 62 of which only two cartridges are shown in the drawings for the sake of simplicity. Each cartridge is similar to the cartridge 32 in FIG. 3 and contains an Ink of a different color, for example black, magenta, cyan and blue.

The support structure 60 comprises four intermediate reservoirs 161, 162, 163 and 164 corresponding to the four cartridges and similar to the reservoir 16 in FIG. 2, each reservoir being provided with a tubular element 361–364 capable of perforated corresponding closure elements 502–503 of the cartridges 62. Each intermediate reservoir is closed at the bottom by the same number of printing elements 351–354 which are similar to the element 35 in FIG. 2, wherein each printing element can print on the same printing carrier in succession with its own colored ink.

Figure 8:
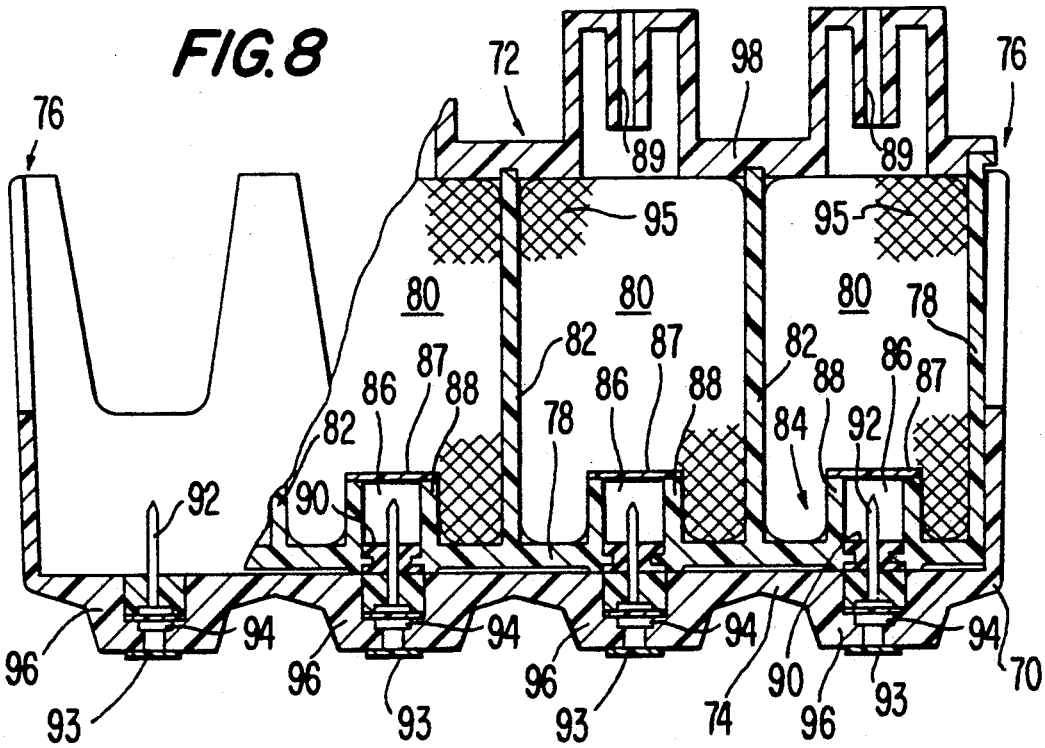
FIG. 8 is a view in longitudinal section of a multicolor print head having a single cartridge for inks of different colors.

FIG. 8 shows a support structure 70 capable of accommodating a single cartridge 72 which is divided for example into a plurality of independent reservoirs or compartments, each filled with an ink of a different color.

The structure 70 comprises an end wall 74 of rectangular shape provided with angular grooves 76 disposed at the four corners and capable of accommodating and guiding the cartridge 72.

The cartridge 72 is formed by a container 78 of parallelepipedic shape and divided for example into four separate compartments 80 by walls 82. Disposed on the bottom 84 of each compartment is a chamber 86 for collecting the ink, which is delimited by a cylindrical wall 88 and which is open towards the interior of the same compartment by way of a grill 87. The chamber 86 is also closed by a closure element 90 passing through the bottom 84 and formed from soft rubber. Disposed on the wall 74 at a position corresponding to each element 90 are tubes 92 having a pointed end, the tubes being capable of perforating the elements 90 and penetrating into the chambers 86 when the cartridge 72 is fitted to the structure 70. The tubes 92 communicate with auxiliary reservoirs 94 provided in external projection portions 96 on the bottom wall 74. Each reservoir 94 is closed by a thermal ink jet printing element 93 of the type described hereinbefore.

Each compartment 80 of the cartridge 72 is filled with a spongy material 95 capable of being impregnated with an ink of a different color.

The printing elements 93 are aligned with each other and disposed parallel to the direction of forward movement of the head during the printing operation. In that way it is possible to effect printing selectively with each of the four colors or with different color shades, by emitting drops of ink of different colors in the same printing position. The cartridge 72 is closed upwardly by a cover 98 welded to the side walls and the separating walls 82 in such a way as completely to isolate the compartments 80 from each other. Conduits 89 disposed on the cover 98 communicate each compartment 80 with the external atmospheric pressure.

Thus, in summary, in the thermal ink jet print head illustrated the ink is expelled in the form of small drops through a plurality of nozzles communicating with corresponding explusion chambers for expulsion of the ink through the effect of rapid heating of heater elements contained in the expulsion chambers. The nozzles, the expulsion chambers, the heater elements and the associated electrical conductors are constructed in a plurality of metal layers and insulating layers supported by a silicon plate. The plate is fixed to the structure of the head and is supplied with ink contained in a removable cartridge fitted to the structure of the head. The cartridge comprises a rigid reservoir containing a sponge saturated with ink and can be hydraulically connected to the head by means of a needle-type conduit mounted on the head and which perforates a rubber membrane of the cartridge. During periods of storage and inactivity of the head, the cartridge can be removed, permitting drying of the nozzles so as to avoid possible nozzle blockages and corrosion of the layers of the plate by the ink.

It will be appreciated that modifications, additions or substitution of parts and/or variations in form may be made in the print head according to the present invention without thereby departing from the scope of the invention.

What is claimed is:

1. A print head for a thermal ink jet printer, mounted on a cartridge movable along a printing carrier for printing information on said printing carrier by ejecting droplets of ink through at least a nozzle, said printing head comprising in combination a supporting structure integral with said carriage and comprising receiving means for removably accommodating a disposable ink cartridge, said receiving means defining a space closed at one end by a bottom wall of said structure and open at the opposite end to allow the introduction of said cartridge, a multilayer printing element fixedly mounted on said structure on an external surface of said bottom wall and formed by a silicon plate supporting a plurality of insulating and metal layers carrying said nozzle, an intermediate ink reservoir mounted on an extension of said support structure, and providing a communication path with said nozzle, said ink cartridge comprising a container formed by rigid side walls and an end wall and filled with ink-impregnated porous material, said container comprising an ink receiving chamber which is delimited by said end wall and by at least one of said side walls and by a third wall which is internally fixed with respect to and perpendicular to said end wall, said chamber protruding inward of said container to locally compress said porous material, said receiving chamber being on one side open towards the interior of said container and on the opposite side being closed by a perforatable closure element fixed to said end wall, said receiving chamber being provided on its interior opening with a grid for preventing said porous material from penetrating into said chamber and to allow said chamber to be filled with ink, and a tubular element fixed with respect to said structure and communicating with said intermediate reservoir, said tubular element extending within said receiving means for perforating said closure element and for hydraulically connecting said container to said intermediate reservoir when said cartridge is inserted into said receiving means.

2. A print head according to claim 1 in which said receiving means comprise four annular guide elements which are fixed with respect to said end wall and which independently extend perpendicularly to said end wall to guide and support said cartridge on said head.

3. An ink cartridge which can be removably fitted to a thermal ink jet head including a silicon substrate supporting a plurality of insulating and metal layers having at least a nozzle for expelling dots of ink, said cartridge comprising a container formed by rigid side walls symmetrically disposed with respect to a longitudinal axis, and an end wall and filled with ink-impregnated porous material, said container comprising an auxiliary extending chamber disposed in a lateral position with respect to said longitudinal axis, said chamber being delimited by said end wall and at least a side wall and by a third wall fixed to said end wall and extending into said container parallel to said side walls, said auxiliary chamber being on one side open towards the interior of said container and on the opposite side being closed by a perforatable closure element fixed to said end wall, said closure element being pierced by a hollow needle through which ink communication between said auxiliary chamber and said nozzle is established, said auxiliary chamber being provided on its interior opening with a grid for preventing said porous material from penetrating into said chamber and to allow said chamber to be filled with ink, said chamber protruding inward said container to locally compress said porous material for increasing the capillarity thereof.

4. An ink cartridge according to claim 3, wherein said head comprises a support structure for receiving a single disposable ink cartridge, and a plurality of multilayer thermal printing elements disposed in said support structure each element carrying a plurality of nozzles for the emission of drops of ink of different colors; said cartridge comprising an ink container subdivided into a plurality of mutually separate compartments, each compartment being filled with a porous material impregnated with an ink of different color and each compartment comprising an auxiliary chamber filled with ink and free from said porous material, each of said chambers protruding toward the interior of each compartment to locally compress the porous material for increasing the capillarity thereof.

* * * * *